US006923208B2

(12) United States Patent
Okabe et al.

(10) Patent No.: US 6,923,208 B2
(45) Date of Patent: Aug. 2, 2005

(54) FLUID SUPPLY DEVICE

(75) Inventors: Kenji Okabe, Obu (JP); Yoshio Ebihara, Kariya (JP); Tatsuo Sakai, Kariya (JP)

(73) Assignee: Denso Corporation (JP)

( * ) Notice: Subject to any disclaimer, the term of this patent is extended or adjusted under 35 U.S.C. 154(b) by 133 days.

(21) Appl. No.: 10/462,745

(22) Filed: Jun. 17, 2003

(65) Prior Publication Data

US 2004/0000344 A1 Jan. 1, 2004

(30) Foreign Application Priority Data

Jun. 28, 2002 (JP) ..... 2002-189351

(51) Int. Cl.[7] ..... F02M 37/14; B60K 15/077
(52) U.S. Cl. ..... 137/565.22; 123/509
(58) Field of Search ..... 137/565.22; 123/509, 123/511, 514; 417/151

(56) References Cited

U.S. PATENT DOCUMENTS 5,875,816 A 3/1999 Frank et al.
5,960,775 A 10/1999 Tuckey
6,062,203 A 5/2000 Takahashi et al.
6,098,600 A 8/2000 Umetsu et al.
6,308,691 B1 10/2001 Frank et al.
6,619,271 B2 * 9/2003 Iwamoto et al. ..... 123/509
6,705,298 B2 * 3/2004 Ramamurthy et al. ..... 123/509

FOREIGN PATENT DOCUMENTS

GB 2 340 096 2/2000

* cited by examiner

*Primary Examiner*—Kevin Lee
(74) *Attorney, Agent, or Firm*—Nixon & Vanderhye PC

(57) ABSTRACT

In a fuel supply device disposed in a fuel tank, a pump module is constructed with at least a fuel pump, a fuel filter and a pressure regulator, and is installed in a sub-tank. A filter case of the fuel filter has first ribs and second ribs, so that an axially position between the pump module and the sub-tank is set by the first ribs, and a circumferential position therebetween is set by the second ribs. Further, a fuel inlet of a jet pump is formed in an inner bottom surface of the sub-tank, and an inner surface of the fuel inlet of the jet pump is tapered. Therefore, a fuel outlet of the pressure regulator is guided while being connected to the fuel inlet of the jet pump. Accordingly, the fuel supply device can be assembled easily.

20 Claims, 5 Drawing Sheets

FLUID SUPPLY DEVICE

CROSS REFERENCE TO RELATED APPLICATION

This application is based on Japanese Patent Application No. 2002-189351 filed on Jun. 28, 2002, the disclosure of which is incorporated herein by reference.

BACKGROUND OF THE INVENTION

1. Field of the Invention

The present invention relates to a fluid supply device, which is installed in a fluid tank, for supplying fluid in the fluid tank to other devices outside the fluid tank. The fluid supply device can be suitably used for supplying fuel.

2. Description of Related Art

A fuel supply device 100 shown in FIGS. 5 and 6, is generally placed in a fuel tank (not shown) and supplies fuel in the fuel tank to other devices outside the fuel tank. A flange 102 of the fuel supply device 100 is fixed to the fuel tank. A metal pipe 106 connects the flange 102 with a filter case 112 that covers a fuel filter 110. The filter case 112 has an arc-shape in cross-section and is disposed around a fuel pump 120. The fuel filter 110, the fuel pump 120 and a pressure regulator 130 are placed inside a sub-tank 132. The fuel pump 120 discharges fuel by rotating its rotation member, such as an impeller. The discharged fuel from the fuel pump 120 passes through a filter element in the filter case 112, so that dust contained in the fuel are removed. Moreover, the fuel passes through the pressure regulator 130, so that the pressure of the fuel is regulated. Then, the pressure-regulated fuel is supplied to the other devices outside the fuel tank, such as a fuel injector, through a fuel outlet pipe 104. The pressure regulator 130 communicates with a jet pump 140 through a fuel pipe 142. The jet pump 140 introduces oversupplied fuel discharged from the pressure regulator 130 to the sub-tank 132 from a fuel inlet 134 of the sub tank-132.

However, in the fuel supply device 100, the pressure regulator 130 is placed inside the sub-tank 132, and the jet pump 140 is placed outside the sub-tank 132. Therefore, it is required to communicate a fuel outlet of the pressure regulator 130 and a fuel inlet of the jet pump 140 by the fuel pipe 142 that is bent complexly and has a long length.

SUMMARY OF THE INVENTION

In view of the above-described problems, it is an object of the present invention to provide a fluid supply device, in which a pressure regulator and a jet pump can be easily connected when a pump module is installed in a sub-tank.

It is another object of the present invention to provide a fluid supply device, which can prevent a part of the pump module from being removed, while the pump module is readily installed in the sub-tank.

According to the present invention, a fluid supply device for supplying a fluid of a fluid tank to an outside of the fluid tank includes a fluid pump that sucks and discharges the fluid, a fluid filter including a filter element for filtering the fluid supplied from the fluid pump, a pressure regulator for regulating a pressure of the fluid flowing out of the fluid filter, a sub-tank disposed in the fluid tank, for housing the fluid filter, the fluid pump and the pressure regulator, and a jet pump that is disposed for supplying the fluid from the fluid tank to the sub-tank by negative pressure generated while discharging surplus fluid from the pressure regulator.

In the fluid supply device, the fluid pump, the fluid filter and the pressure regulator are assembled to form a pump module, and are installed in the sub-tank. Further, the jet pump has a fuel inlet placed inside the sub-tank, and the fluid inlet of the jet pump and a fluid outlet of the pressure regulator are directly connected to each other. Therefore, the pressure regulator and the jet pump can be connected without using a pipe member. In addition, one of the fluid outlet of the pressure regulator and the fluid inlet of the jet pump has a guide portion that guides the other one thereof when the jet pump and the pressure regulator are connected. Accordingly, the connection position can be readily set when the fluid inlet of the jet pump and the fluid outlet of the pressure regulator are directly connected to each other.

Preferably, the guide portion is a tapering inner surface provided on the fluid inlet of the jet pump, and the tapering inner surface is provided such that an inner diameter of the fluid inlet of the jet pump becomes smaller in a connection direction from the fluid outlet of the pressure regulator to the fluid inlet of the jet pump. Therefore, the connection between the regulator and the jet pump can be smoothly performed.

On the other hand, the pump module has a module position setting member for setting an arrangement position of the pump module in the sub-tank when the pump module is installed in the sub-tank. For example, the module position setting member includes a first position setting portion for axially setting the position of the pump module in the sub-tank, and a second position setting portion for circumferentially setting the position of the pump module in the sub-tank. In this case, the pump module is readily installed in the sub-tank at a predetermined arrangement position while it prevent a part of the pump module from being removed.

BRIEF DESCRIPTION OF THE DRAWINGS

Other objects, features and advantages of the present invention will become more apparent from the following detailed description made with reference to the accompanying drawings, in which.

DETAILED DESCRIPTION OF THE PRESENTLY PREFERRED EMBODIMENT

A preferred embodiment of the present invention will be described hereinafter with reference to the accompanying drawings.

Figure 1:
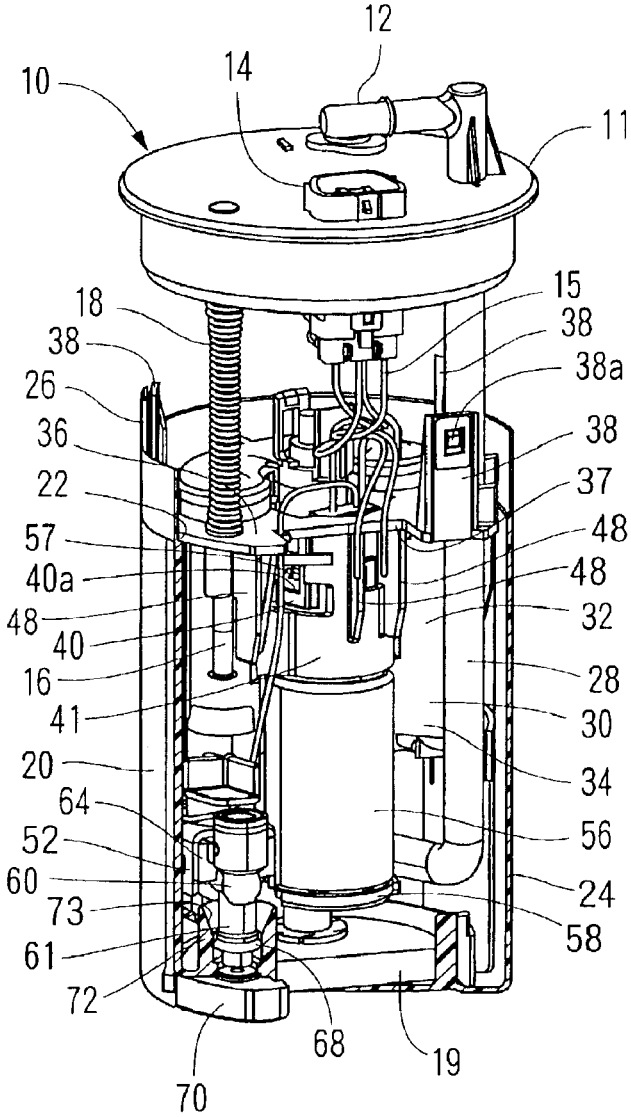
FIG. 1 is a partially-broken perspective view of a fuel supply device according to an embodiment of the present invention.

As shown in FIG. 1, a fuel supply device 10 includes a circular flange portion 11, to which a fuel outlet pipe 12 and an electric connector 14 are attached. The flange portion 11 has a circular flange that is engaged with an upper wall of a fuel tank (not shown) made of resin, so that members of the fuel supply device 10, except for the flange portion 11, the fuel outlet pipe 12 and the electric connector 14, are placed inside the fuel tank.

The fuel outlet pipe 12 supplies fuel discharged from a fuel pump 56, which is placed in a sub-tank 20, to the outside of the fuel tank. Electricity is supplied from the electric connector 14 to the fuel pump 56 that is an electrically operated type, through lead wires 15.

A metal pipe 16 loosely penetrates through a case cover 36 of a filter case 32, and one end of which is press-fixed into the flange portion 11. A spring 18 is disposed between the case cover 36 and the flange portion 11, and both ends of the spring 18 are respectively fixed to the flange portion 11 and the case cover 36, so that the flange portion 11 and the case cover 36 are biased by the spring 18 to be separated from each other. The inner surface of the sub-tank 20 has a stepped portion 22 around an opening of the sub-tank 20. Moreover, the stepped portion 22 is engaged with the case cover 36, so that the case cover 36 is restricted to shift lower than the stepped portion 22. Therefore, even when the fuel tank, which is made of resin, is expanded or constricted by change of inner pressure or the fuel amount therein caused by change of the temperature, the bottom of the sub-tank 20 is normally pressed on the inner bottom surface of the fuel tank by the spring force of the spring 18.

A suction filter 19, a fuel filter 30, the fuel pump 56, a pressure regulator 60 and the like are placed inside the sub-tank 20. The suction filter 19 collects relatively large blobs contained in the fuel sucked by the fuel pump 56 from the sub-tank 20.

Figure 3:
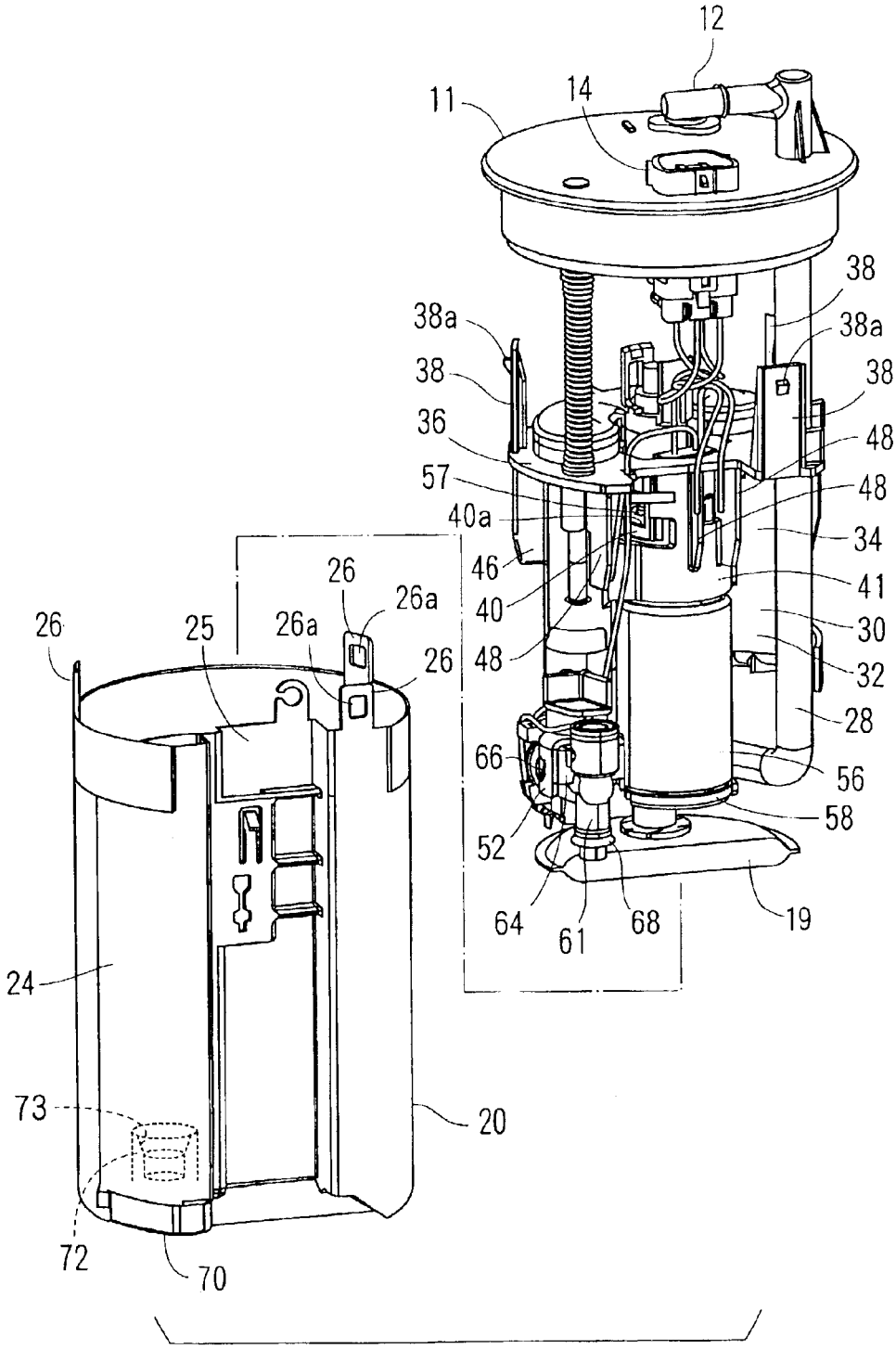
FIG. 3 is an exploded perspective view of the fuel supply device according to the embodiment of the present invention.

As shown in FIG. 3, the sub-tank 20 has a substantially cylindrical shape having a bottom portion. A cylindrical portion 24 of the sub-tank 20 has an elongated concavity 25, extending an axial direction thereof. Moreover, three projections 26, extending in the axial direction, are formed at predetermined intervals to protrude from an opening end of the sub-tank 20. Each of the projections 26 has an engaging hole 26, penetrating through the projection 26. The sub-tank 20 has a fuel inlet 72 for a jet pump 70, on an inside surface of the bottom portion of the sub-tank 20. The fuel inlet 72 of the sub-tank 20 has a guide surface 73. The guide surface 73 is tapered, so that an inner diameter of the fuel inlet 72 becomes smaller toward the jet pump 70.

The fuel filter 30 includes a filter case 32 and a filter element (not shown)-disposed in the filter case 32. The filter element collects a smaller one of the blobs in the fuel supplied from the fuel pump 56. The filter case 32 covers the fuel pump 56, and has an arc-shape in cross-section. The filter case 32 includes a case main body 34 and the case cover 36, which covers the case main body 34 and is engaged with the stepped portion 22 of the sub-tank 20.

Figure 2:
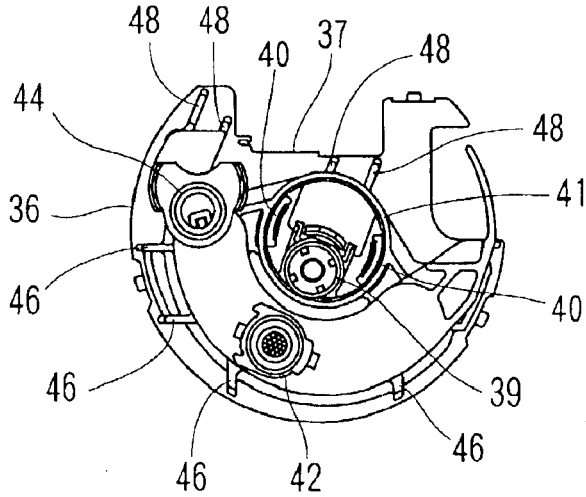
FIG. 2 is a bottom view showing a case cover and neighboring members thereof when being viewed from a fuel pump of the fuel supply device according to the embodiment of the present invention.

As shown in FIG. 2, the case cover 36 has a concavity 37 at a position corresponding to the elongated concavity 25 of the sub-tank 20. Moreover, as shown in FIGS. 2, 3, the case cover 36 has three projections 38, a fuel inlet 39, two holding portions 40, a pump connector 41, an electric connector 42, a circulating connector 44, first ribs 46 (first module position setting portion) and second ribs 48 (second module position setting portion). The projections 38 are disposed around a circumferential edge of the case cover 36, to project from the circumferential edge of the case cover 36 toward the flange of the flange portion 11. The fuel inlet 39 is directly connected to the fuel outlet of the fuel pump 56, and is press-fitted to the fuel outlet of the fuel pump 56. The connector 41 is for being connected with an upper end of the fuel pump 56. The electric connector 42 is electrically connected with the lead wires 15. Through the circulating connector 44, the fuel discharged from the fuel pump 56 is supplied into the case main body 34 of the filter case 32.

As shown in FIG. 3, the projections 38 are formed in the upper circumferential edge of the case cover 36 of the filter case 32, to correspond to the arrangement positions of the projections 26 of the sub-tank 20. Each of the projections 38 has an engaging claw 38*a* for engaging with the engaging hole 26*a* of the corresponding projection 26 of the sub-tank 20. The first ribs 46 of the case cover 36 of the filter case 32 are respectively engaged with an inner surface of the cylindrical portion 24 of the sub-tank 20 in order to determine an arrangement position of a pump module. The second ribs 48 of the case cover 36 of the filter case 32 are engaged with an inner surface of the elongated concavity 25 of the sub-tank 20 in order to determine the arrangement position of the pump module.

As shown in FIG. 1, the fuel pump 56 is disposed inside the sub-tank 20, such that the fuel discharging portion (not shown) of the fuel pump 56 is positioned at an upper side, and a fuel suction portion 58 thereof is positioned at a lower side in a vertical direction. The fuel pump 56 has an electric motor (not shown) therein and a rotatable impeller. The impeller rotates by the electric motor, so that the fuel pump 56 sucks the fuel. The fuel outlet of the fuel pump 56 and the fuel inlet 39 of the filter case 32 are fitted with each other to be directly connected to each other.

The fuel discharge portion, including the fuel outlet of the fuel pump 56, is coated with resin. Two engaging claws 57 are formed in a circumferential edge of the fuel discharge portion of the fuel pump 56 at equal intervals. The two holding portions 40 are formed in the inner circumference of the pump connector 41 of the case cover 36 of the ilter case 32, such that the positions of the holding portions 40 respectively correspond to the positions of the engaging claws 57. Each holding portion 40 has a square engaging hole 40*a*, so that each engaging claw 57 is engaged with the corresponding engaging hole 40*a*. In this way, the fuel pump 56 is prevented from detaching from the fuel filter 30. The fuel discharging portion of the fuel pump 56 is press-fitted to the pump connector 41 of the case cover 36 of the filter case 32. The fuel suction portion 58 of the fuel pump 56, which is an opposite end relative to the fuel discharging portion, is a free end that is not engaged with or fastened to other members.

Figure 4:
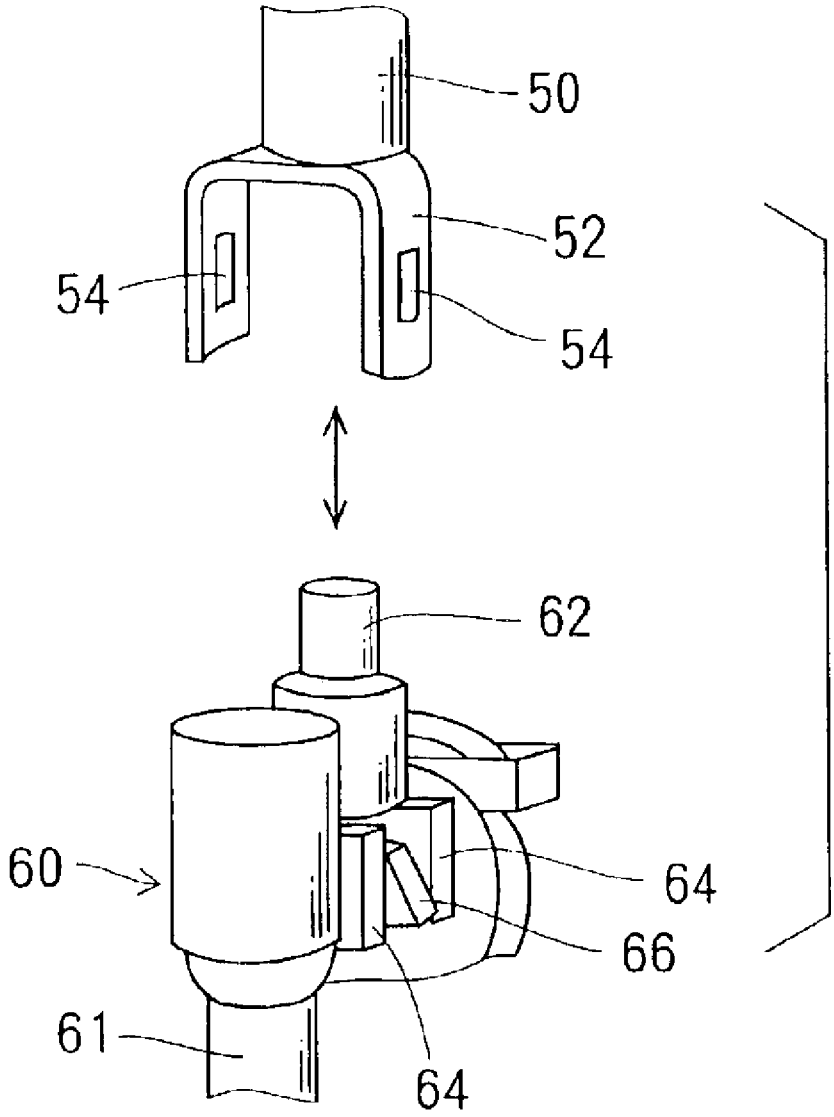
FIG. 4 is a perspective view for explaining a connection state of a filter case and a pressure regulator of the fuel supply, according to the embodiment of the present invent.
Figure 5:
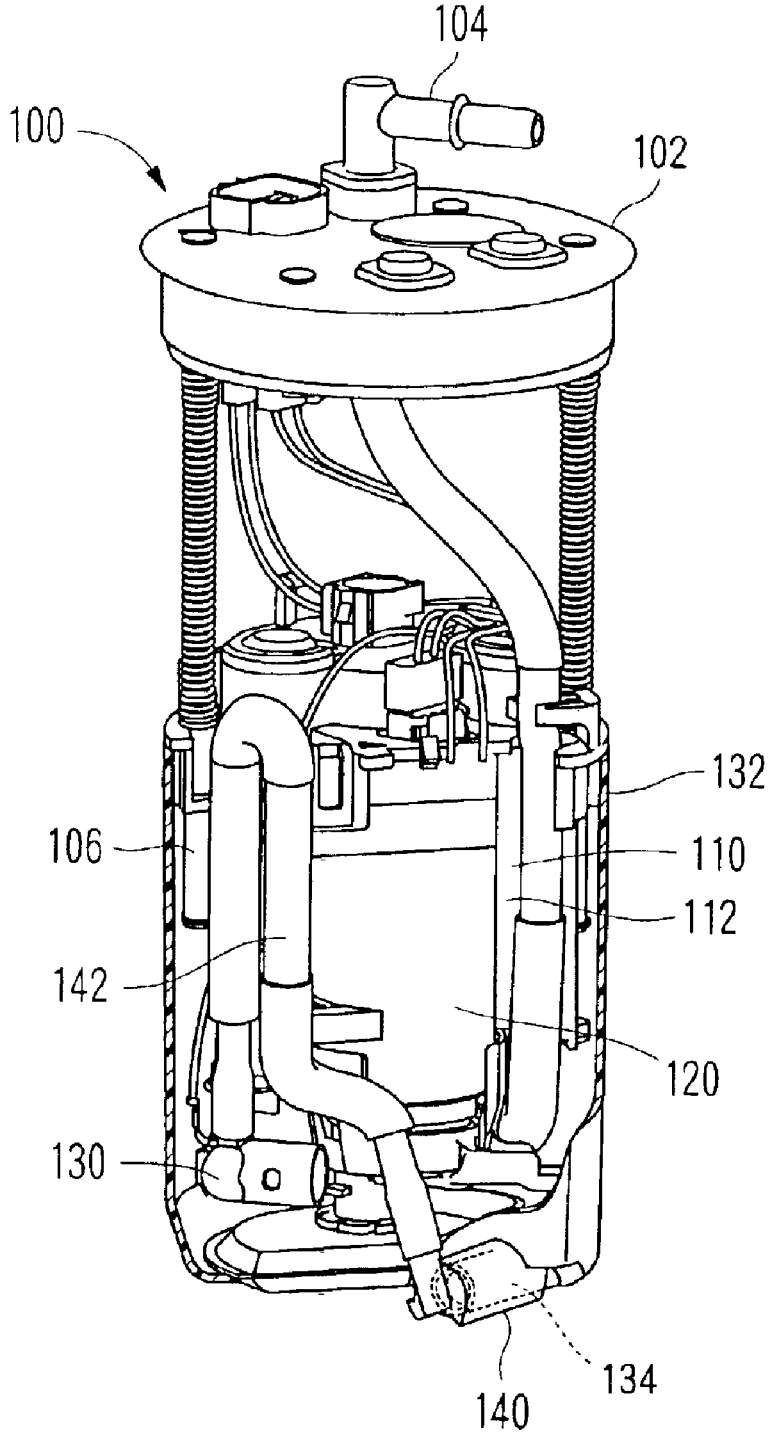
FIG. 5 RELATED ART
FIG. 5 is a partially-broken perspective view of a fuel supply device in a related art.
Figure 6:
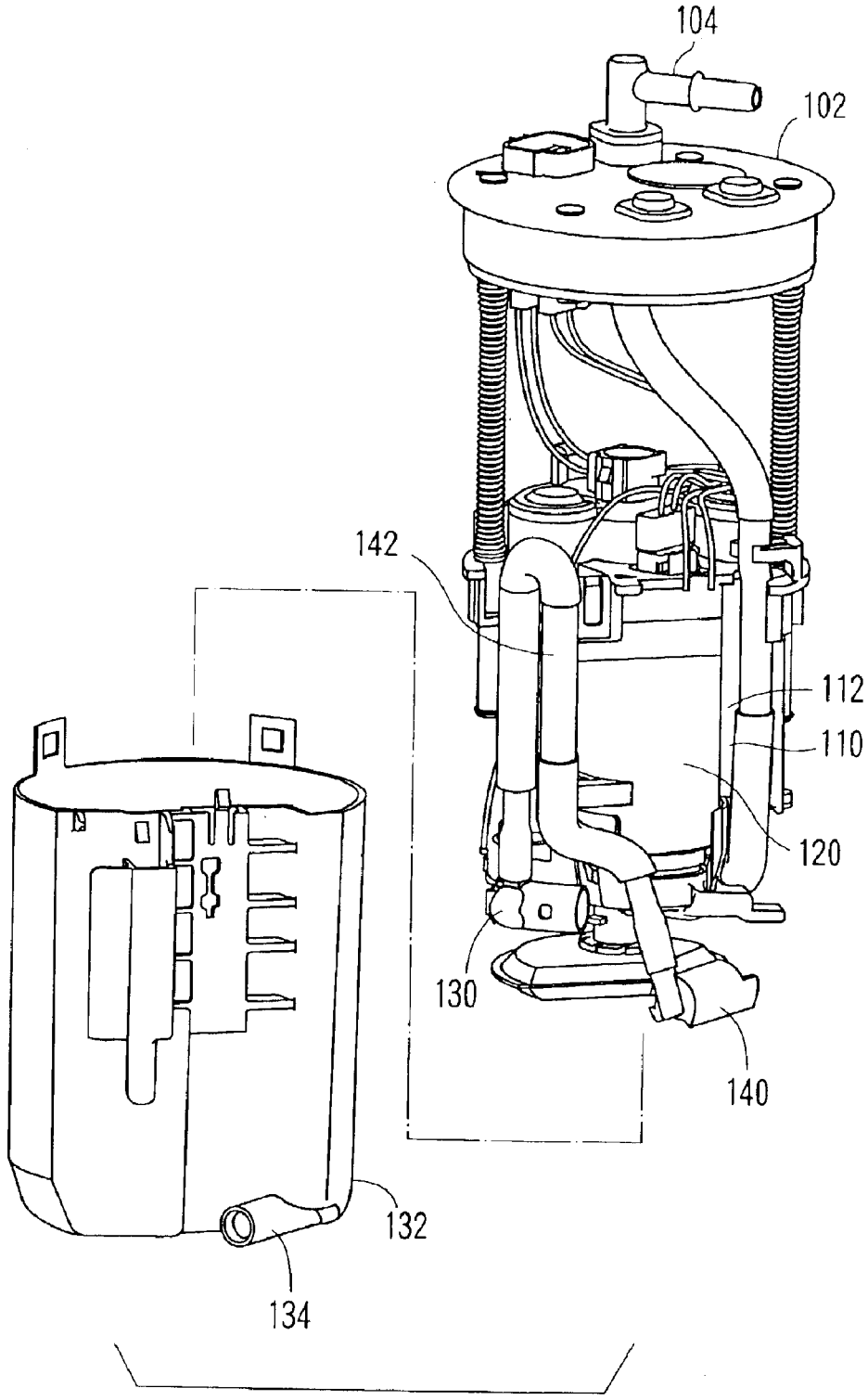
FIG. 6 RELATED ART
FIG. 6 is an exploded perspective view of the fuel supply device in FIG. 5.

The pressure regulator 60 regulates the pressure of the fuel, which is discharged from the fuel pump 56 and passes through the fuel filter 30 and flows toward the fuel outlet pipe 12. As shown in FIG. 4, a fuel inlet 62 of the pressure regulator 60 and a fuel outlet 50 of the case main body 34 of the filter case 32 are engaged to be directly connected to each other. Moreover, the pressure regulator 60 has two couples of guides 64 (regulator position setting members) and two engaging claws 66. Specifically, each engaging claw 66 is inserted between the corresponding couple of the guides 64. One couple of the guides 64 and the engaging claw 66 between the couple of the guides 64 are not shown in FIG. 4. A fuel outlet 50 of the case main body 34 has a substantially U-shaped arm 52, and each side portion of which respectively has an engaging hole 54, so that each of the engaging holes 54 is engaged with the corresponding one of the engaging claws 66. In this way, the pressure regulator 60 is restricted to be detached from the fuel filter 30. A fuel outlet 61 of the pressure regulator 60 and the fuel inlet 72 of the jet pump 70 are directly connected to each other. Generally, an O-ring 68 is disposed between the fuel outlet 61 of the pressure regulator 60 and the fuel inlet 72 of the jet pump 70 to seal therebetween.

The jet pump 70 is fixed to the sub-tank 20, for example, by way of the ultrasonic adhesion. When the pressure regulator 60 regulates the pressure of the fuel flowing through the fuel filter 30 and the fuel pipe 28 toward the fuel outlet pipe 12, the pressure regulator 60 discharges the excess fuel through the fuel outlet 61. The excess fuel is injected from a nozzle (not shown) of the jet pump 70 into the sub-tank 20 through the fuel inlet 72. The fuel injection from the nozzle of the jet pump 70 causes the negative pressure around the nozzle. By using the negative pressure, the fuel in the fuel tank flows into the sub-tank 20. Therefore, even when the amount of the fuel in the fuel tank is reduced, the sub-tank 20 is filled with the fuel.

Next, the positioning method for determining the arrangement position of the fuel supply device 10 in an assembling process will be described. For example, the pump module is constructed with the flange portion 11, the suction filter 19, the fuel filter 30 connected to the flange portion 11 by the metal pipe 16, the fuel pump 56 and the pressure regulator 60.

First, as shown in FIG. 4, the fuel outlet 50 of the filter case 32 is connected to the fuel inlet 62 of the pressure regulator 60. In this case, each side end potion of the U-shaped arm 52 of the filter case 32 is inserted to be clamped between the guides 64 of the pressure regulator 60, so that the connecting position between the fuel outlet 50 of the filter case 32 and the fuel inlet 62 of the pressure regulator 60 are set. Moreover, each engaging claw 66 is engaged with the corresponding engaging hole 54 of the U-shaped arm 52, so that the fuel outlet 50 of the filter case 32 and the fuel inlet 62 of the pressure regulator 60 are tightly engaged with each other.

Next, the pump module is installed in the sub-tank 20. In this case, the first ribs 46 of the case cover 36 of the filter case 32 contact the inner surface of the cylindrical portion 24 of the sub-tank 20, so that the arrangement position between the case cover 36 and the sub-tank 20, i.e., between the pump module and the sub-tank 20 are axially set. Moreover, the second ribs 48 of the case cover 36 of the filter case 32 contact an inner surface of the longitudinal concavity 25 of the cylindrical portion 24, so that the arrangement position between the sub-tank 20 and the pump module are circumferentially set. At this time, the fuel outlet 61 of the pressure regulator 60 is inserted into the fuel inlet 72, while being guided by the guide surface 73 of the fuel inlet 72, so that the fuel outlet 61 of the pressure regulator 60 and the fuel inlet 72 of the jet pump 70 are directly connected each other. That is, in the assembling direction of the pump module and the sub-tank 20, the fuel outlet 61 of the pressure regulator 60 and the fuel inlet 72 of the jet pump 70 are coupled. Further, the engaging hole 26*a* of each projection 26 of the sub-tank 20 and the engaging claw 38*a* of the corresponding projection 38 of the case cover 36 of the filter case 32 are engaged.

In the fuel supply device 10, because the fuel outlet 61 of the pressure regulator 60 and the fuel inlet 72 of the jet pump 70 are directly connected, it is unnecessary to provide a fuel pipe for connecting the pressure regulator 60 and the jet pump 70. Therefore, it is easy to connect the pressure regulator 60 and the jet pump 70.

Moreover, as described above, the pump module is installed in the sub-tank 20, while the axial position is determined by using the first ribs 36 and the circumferential position is determined by using the second ribs 48. Accordingly, the connection position between the fuel outlet 61 of the pressure regulator 60, that is, a part of the pump module, and the fuel inlet 72 of the jet pump 70, which is formed in the inside bottom surface of the sub-tank 20, can be determined easily and accurately.

The guide surface 73 of the fuel inlet 72 is tapered, such that the inner diameter of the fuel inlet 72 of the jet pump 70 becomes smaller toward inside of the jet pump 70. Accordingly, the fuel outlet 61 of the pressure regulator 60 is guided by the tapered guide surface 73, so that the connection between the fuel outlet 61 and the fuel inlet 72 is performed easily.

Moreover, the connection between the fuel outlet 50 of the case main body 34 of the filter case 32 and the fuel inlet 62 of the pressure regulator 60 is performed, such that each side end portion of the U-shaped arm 52 of the fuel outlet 50 is inserted between the corresponding couple of the guides 64 of the pressure regulator 60. Accordingly, the arrangement position of the fuel outlet 61 of the pressure regulator 60 in the pump module can be set accurately. Therefore, when the pump module is installed in the sub-tank 20, the arrangement position between the fuel outlet 61 and the fuel inlet 72 can be set accurately.

In the present invention, the fuel pump 56 and the pressure regulator 60 are engaged with the filter case 32 of the fuel filter 30, so that the fuel pump 56 and the pressure regulator 60 are prevented from being detached from the fuel filter 30. Accordingly, the pump module can be easily installed in the sub-tank 20.

Although the present invention has been fully described in connection with the preferred embodiment thereof with reference to the accompanying drawings, it is to be noted that various changes and modifications will become apparent to those skilled in the art.

For example, in the above-described embodiment of the present invention, the fuel outlet of the fuel pump 56 and the fuel inlet 39 of the filter case 32 are directly coupled. However, when the pump module is possible to be installed in the sub-tank 20 all together, the fuel outlet of the fuel pump 56 and the fuel inlet 39 of the filter case 32 can be coupled by using a fuel pipe. In addition, the fuel outlet 50 of the filter case 32 and the fuel inlet 62 of the pressure regulator 60 can be coupled by using a fuel pipe.

Moreover, in the above described embodiment, the position determination between the pump module and the sub-tank 20 is performed by the first ribs 46 and the second ribs 48, which are used as the module position determining members, of the case cover 36. However, the module position determining member may be formed in the pump module, other than the case cover 36. Moreover, the guides 64, serving as the regulator position determining member, are formed in the pressure regulator 60. However, the regulator position determining member may be formed in the filter case 32.

Furthermore, the fuel inlet 72 of the jet pump 70 has the tapered guide surface 73 to the fuel outlet 61 of the pressure regulator 60. However, a tapered guide surface for guiding may be formed in the fuel outlet 61 of the pressure regulator 60. Otherwise, the inside surface of one of the fuel inlet 72 and the fuel outlet 61 may be has a concave, convex or stepped surface, in which the inner diameter of the corresponding fuel inlet or outlet becomes smaller in a coupling direction thereof.

In the above-described embodiment, the present invention is typically applied to the fuel supply device for supplying the fuel from the fuel tank to the engine. However, the present invention can be applied to a fluid supply device for supplying a fluid other than the fuel.

Such changes and modifications are to be understood as being within the scope of the present invention as defined by the appended claims.

What is claimed is:

1. A fluid supply device for supplying a fluid of a fluid tank to an outside of the fluid tank, the fluid supply device comprising:

a fluid pump that sucks and discharges the fluid;

a fluid filter including a filter element for filtering the fluid supplied from the fluid pump, and a filter case covering the filter element;

a pressure regulator for regulating a pressure of the fluid flowing out of the fluid filter;

a sub-tank disposed in the fluid tank, for housing the fluid filter, the fluid pump and the pressure regulator; and a jet pump that is integrally fixed at a bottom of the sub tank for supplying the fluid from the fluid tank to the sub-tank by negative pressure generated while discharging surplus fluid from the pressure regulator, wherein the fluid pump, the fluid filter and the pressure regulator are assembled to form a pump module, and are installed in the sub-tank;

the jet pump has a fuel inlet placed inside the sub-tank, and the fluid inlet of the jet pump and a fluid outlet of the pressure regulator are directly connected to each other; and one of the fluid outlet of the pressure regulator and the fluid inlet of the jet pump has a guide portion that guides the other one thereof when the jet pump and the pressure regulator are connected.

2. The fluid supply device according to claim 1, wherein the guide portion is a tapering inner surface provided on the fluid inlet of the jet pump, and the tapering inner surface is provided such that an inner diameter of the fluid inlet of the jet pump becomes smaller in a connection direction from the fluid outlet of the pressure regulator to the fluid inlet of the jet pump.

3. The fluid supply device according to claim 1, wherein the pump module has a module position setting member for setting an arrangement position of the pump module in the sub-tank when the pump module is installed in the sub-tank.

4. The fluid supply device according to claim 3, wherein the module position setting member includes:

a first position setting portion for axially setting the position of the pump module in the sub-tank; and a second position setting portion for circumferentially setting the position of the pump module in the sub-tank.

5. The fluid supply device according to claim 4, wherein the second position setting portion restricts a rotation of the pump module in the sub-tank.

6. The fluid supply device according to claim 1, wherein the pressure regulator has a fluid inlet that is directly connected to a fluid outlet of the filter case.

7. The fluid supply device according to claim 6, wherein one of the filter case and the pressure regulator has a regulator position setting member for setting a connection position between the filter case and the pressure regulator when the filter case and the pressure regulator are connected to each other.

8. The fluid supply device according to claim 6, wherein the filter case has an engagement portion that is directly engaged with an engagement portion of the pressure regulator.

9. The fluid supply device according to claim 1, wherein the fluid pump has a fluid outlet that is directly connected to a fluid inlet of the filter case.

10. The fluid supply device according to claim 9, wherein the filter case has a holding portion for fixing the fluid pump to the filter case.

11. The fluid supply device according to claim 1, wherein the fluid is a fuel used for an engine.

12. A fluid supply device as in claim 1, wherein said jet pump is ultrasonically adhered to the bottom of the sub tank.

13. A fluid supply device for supplying a fluid of a fluid tank to an outside of the fluid tank, the fluid supply device comprising:

a fluid pump that sucks and discharges the fluid; a fluid filter including a filter element for filtering the fluid supplied from the fluid pump, and a filter case covering the filter element;

a pressure regulator for regulating a pressure of the fluid flowing out of the fluid filter;

a sub-tank disposed in the fluid tank, for housing the fluid filter, the fluid pump and the pressure regulator; and a jet pump that is disposed for supplying the fluid from the fluid tank to the sub-tank by negative pressure generated while discharging surplus fluid from the pressure regulator, wherein, the jet pump has a fluid inlet placed inside the sub-tank, and the fluid inlet of the jet pump and a fluid outlet of the pressure regulator are directly connected to each other;

the fluid pump, the fluid filter and the pressure regulator are assembled to form a pump module and are installed in the sub-tank;

the pump module has a module position setting member for setting an arrangement position of the pump module in the sub-tank when the pump module is installed in the sub-tank; and said module position setting member is disposed vertically above the jet pump.

14. A fluid supply device as in claim 13, wherein the module position setting member contacts an inner circumference of the sub-tank.

15. A fluid supply device as in claim 14, wherein the module position setting member includes at least one position setting member that contacts with the inner circumference of a concave portion formed at a side surface of the sub-tank and at least one position setting member that contacts with an inner circumference of the sub-tank other than said concave portion.

16. A fluid supply device as in claim 15, wherein said position setting members contacting the inner circumference of the sub-tank comprise ribs.

17. A fluid supply device as in claim 16, wherein a plurality of said ribs contact the inner circumference of the concave portion and a plurality of said ribs contact the inner circumference of the sub-tank other than said concave portion.

18. A fluid supply device as in claim 13, wherein the filter case has an engagement portion that is directly engaged with an engagement portion of the pressure regulator.

19. A fluid supply device as in claim 13, wherein the fluid pump has a fluid outlet that is directly connected to a fluid inlet of the filter case.

20. A fluid supply device as in claim 19, wherein the filter case has a holding portion for fixing the fluid pump to the filter case.

* * * * *